US011060356B2

(12) United States Patent
Cuillier De Maindreville et al.

(10) Patent No.: US 11,060,356 B2
(45) Date of Patent: Jul. 13, 2021

(54) SUPERABRASIVE CUTTERS FOR EARTH BORING BITS WITH MULTIPLE RAISED CUTTING SURFACES

(71) Applicant: VAREL INTERNATIONAL IND., L.L.C., Carrollton, TX (US)

(72) Inventors: Bruno Cuillier De Maindreville, Pau (FR); Patricia Ann Neal, Houston, TX (US); Samer Tawfiq Alkhalaileh, Dublin, OH (US)

(73) Assignee: VAREL INTERNATIONAL IND., L.L.C., Carrollton, TX (US)

( * ) Notice: Subject to any disclaimer, the term of this patent is extended or adjusted under 35 U.S.C. 154(b) by 55 days.

(21) Appl. No.: 16/496,189

(22) PCT Filed: Apr. 24, 2018

(86) PCT No.: PCT/US2018/029025
§ 371 (c)(1),
(2) Date: Sep. 20, 2019

(87) PCT Pub. No.: WO2018/231343
PCT Pub. Date: Dec. 20, 2018

(65) Prior Publication Data

US 2020/0157890 A1 May 21, 2020

Related U.S. Application Data

(60) Provisional application No. 62/518,850, filed on Jun. 13, 2017.

(51) Int. Cl.

| | |
|---|---|
| ***E21B 10/567*** | (2006.01) |
| ***E21B 10/55*** | (2006.01) |
| *E21B 10/43* | (2006.01) |

(52) U.S. Cl.
CPC ..... *E21B 10/5673* (2013.01); *E21B 10/55* (2013.01); *E21B 10/43* (2013.01)

(58) Field of Classification Search
CPC ..... E21B 10/5673; E21B 10/5676; E21B 10/5735; E21B 10/567
See application file for complete search history.

(56) References Cited

U.S. PATENT DOCUMENTS 6,527,069 B1 * 3/2003 Meiners ..... E21B 10/567 175/432
7,726,420 B2 * 6/2010 Shen ..... E21B 10/5673 175/430

(Continued)

FOREIGN PATENT DOCUMENTS

CN 102164698 A 8/2011
CN 106089089 A 11/2016

(Continued)

*Primary Examiner* — Blake E Michener

(57) ABSTRACT

A cutter for a drill bit includes: a substrate for mounting the cutter to the drill bit; and a cutting table. The cutting table: is made from a superhard material, is mounted to the substrate, has an interface with the substrate at a lower end thereof, and has a working face at an upper end thereof. The working face has a protruding center section and a plurality of protruding ribs. Each rib extends radially outward from the center section to a side of the cutting table. Each rib has a triangular profile formed by a pair of inclined side surfaces and a ridge connecting opposing ends of the side surfaces. The working face further has a plurality of recessed bases located between adjacent ribs and each extending inward from the side.

19 Claims, 8 Drawing Sheets

(56) References Cited

U.S. PATENT DOCUMENTS

| | | | | |
|---|---|---|---|---|
| 7,743,855 | B2 * | 6/2010 | Moss | E21B 10/52 175/374 |
| 8,037,951 | B2 | 10/2011 | Shen | |
| 8,132,633 | B2 | 3/2012 | Cuillier De Maindreville | |
| 8,739,904 | B2 | 6/2014 | Patel | |
| 9,103,174 | B2 | 8/2015 | DiGiovanni | |
| 2005/0247492 | A1 * | 11/2005 | Shen | E21B 10/5735 175/426 |
| 2007/0278017 | A1 * | 12/2007 | Shen | E21B 10/5673 175/426 |
| 2008/0053710 | A1 | 3/2008 | Moss | |
| 2015/0259988 | A1 | 9/2015 | Chen | |
| 2016/0032657 | A1 * | 2/2016 | Zhang | E21B 10/5673 175/430 |
| 2017/0058615 | A1 * | 3/2017 | Liang | E21B 10/5673 |
| 2018/0334860 | A1 * | 11/2018 | Azar | E21B 10/5673 |
| 2019/0010763 | A1 * | 1/2019 | Crockett | E21B 10/5673 |
| 2019/0063160 | A1 * | 2/2019 | Drews | E21B 10/43 |
| 2019/0071932 | A1 * | 3/2019 | Bellin | B22F 7/064 |

FOREIGN PATENT DOCUMENTS

| | | | |
|---|---|---|---|
| CN | 106089090 | A | 11/2016 |
| CN | 205778558 | U | 12/2016 |
| DE | 3025890 | A1 | 1/1982 |
| RU | 125615 | U1 | 3/2013 |
| SU | 1803517 | A1 | 3/2013 |

* cited by examiner

SUPERABRASIVE CUTTERS FOR EARTH BORING BITS WITH MULTIPLE RAISED CUTTING SURFACES

BACKGROUND OF THE DISCLOSURE

Field of the Disclosure

The present disclosure generally relates to superabrasive cutters for earth boring bits with multiple raised cutting surfaces.

Description of the Related Art

U.S. Pat. No. 8,037,951 discloses a cutter for a drill bit used for drilling wells in a geological formation that includes an ultra hard working surface and a chamfer along an edge of the working surface, wherein the chamfer has a varied geometry along the edge. The average geometry of the chamfer varies with cutting depth. A depression in the shaped working surface is oriented with the varied chamfer and facilitates forming the varied chamfer. A non-planar interface has depressions oriented with depressions in the shaped working surface to provide support to loads on the working surface of the cutter when used.

U.S. Pat. No. 8,132,633 discloses a self positioning cutter element and cutter pocket for use in a downhole tool having one or more cutting elements. The self positioning cutter element includes a substrate and a wear resistant layer coupled to the substrate. The cutter element includes a cutting surface, a coupling surface, and a longitudinal side surface forming the circumferential perimeter of the cutter element and extending from the cutting surface to the coupling surface. The cutter element has one or more indexes formed on at least a portion of the coupling surface. In some embodiments, the index also is formed on at least a portion of the longitudinal side surface. Hence, the coupling surface is not substantially planar. Additionally, at least a portion of the longitudinal side surface does not form a substantially uniform perimeter. The cutter pocket also is indexed to correspond and couple with the indexing of the cutter element.

U.S. Pat. No. 8,739,904 discloses cutters for a drill bit wherein the cutters have at least one groove in a face of a superabrasive table of the cutters. The cutters may also include ribs adjacent to the at least one groove.

U.S. Pat. No. 9,103,174 discloses cutting elements including a superabrasive table, at least one indentation in a cutting face of the superabrasive table, and at least one spoke extending radially across at least a portion of the at least one indentation. Earth-boring drill bits include such a cutting element. Methods of forming a cutting element include forming a superabrasive table having at least one such indentation and at least one such spoke, and positioning the superabrasive table on a substrate.

US 2015/0259988 discloses (see FIGS. 55-57) a cutting element including a substrate, an upper surface of the substrate including a crest, the crest transitioning into a depressed region, and an ultrahard layer on the upper surface, thereby forming a non-planar interface between the ultrahard layer and the substrate. A top surface of the ultrahard layer includes a cutting crest extending along at least a portion of a diameter of the cutting element, the top surface having a portion extending laterally away from the cutting crest having a lesser height than a peak of the cutting crest.

SUMMARY OF THE DISCLOSURE

The present disclosure generally relates to superabrasive cutters for earth boring bits with multiple raised cutting surfaces. In one embodiment, a cutter for a drill bit includes: a substrate for mounting the cutter to the drill bit; and a cutting table. The cutting table: is made from a superhard material, is mounted to the substrate, has an interface with the substrate at a lower end thereof, and has a working face at an upper end thereof. The working face has a protruding center section and a plurality of protruding ribs. Each rib extends radially outward from the center section to a side of the cutting table. Each rib has a triangular profile formed by a pair of inclined side surfaces and a ridge connecting opposing ends of the side surfaces. The working face further has a plurality of recessed bases located between adjacent ribs and each extending inward from the side.

In another embodiment, a cutter for a drill bit includes: a substrate for mounting the cutter to the drill bit; and a cutting table. The cutting table: is made from a superhard material, is mounted to the substrate, has an interface with the substrate at a lower end thereof, and has a working face at an upper end thereof. The working face has a protruding center section and a plurality of protruding ribs. Each rib extends spirally outward from the center section to a side of the cutting table. Each rib has a triangular profile formed by a pair of inclined side surfaces and a ridge connecting opposing ends of the side surfaces. The working face further has a plurality of recessed bases located between adjacent ribs and each extending inward from the side.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
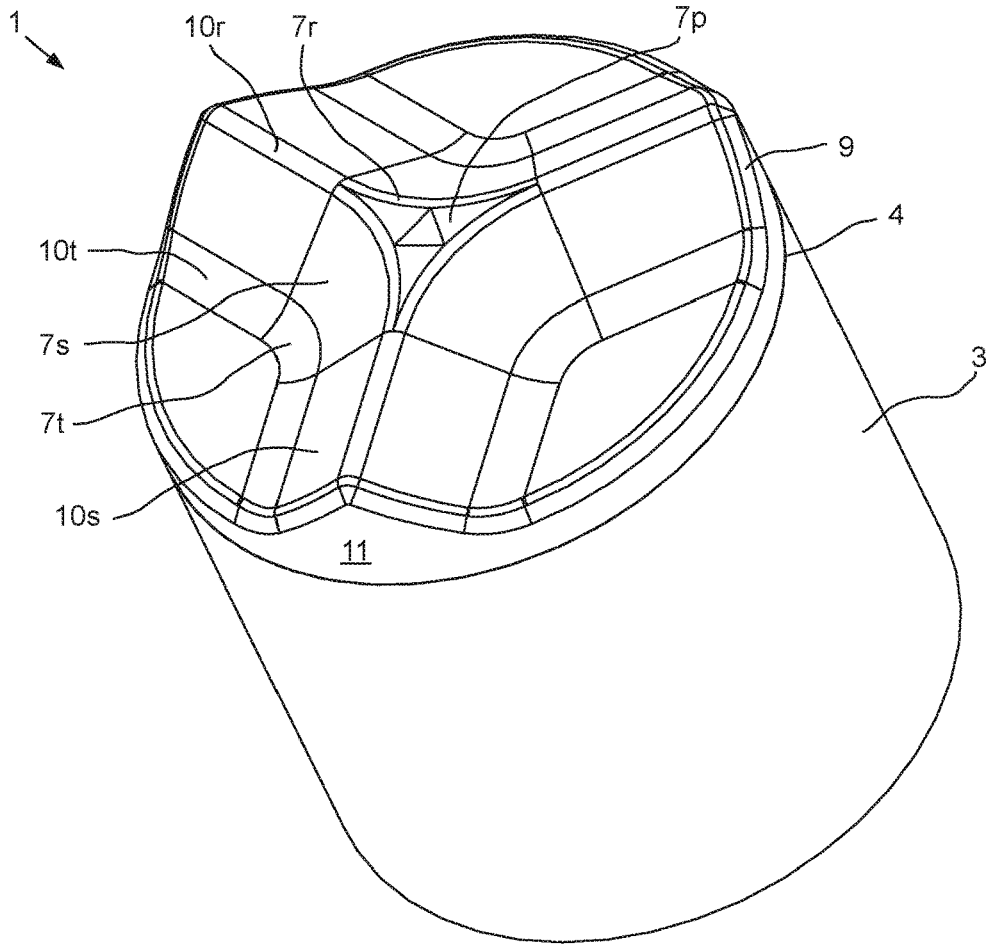
FIG. 1A illustrates a cutter, according to one embodiment of the present disclosure.
Figure 1B:
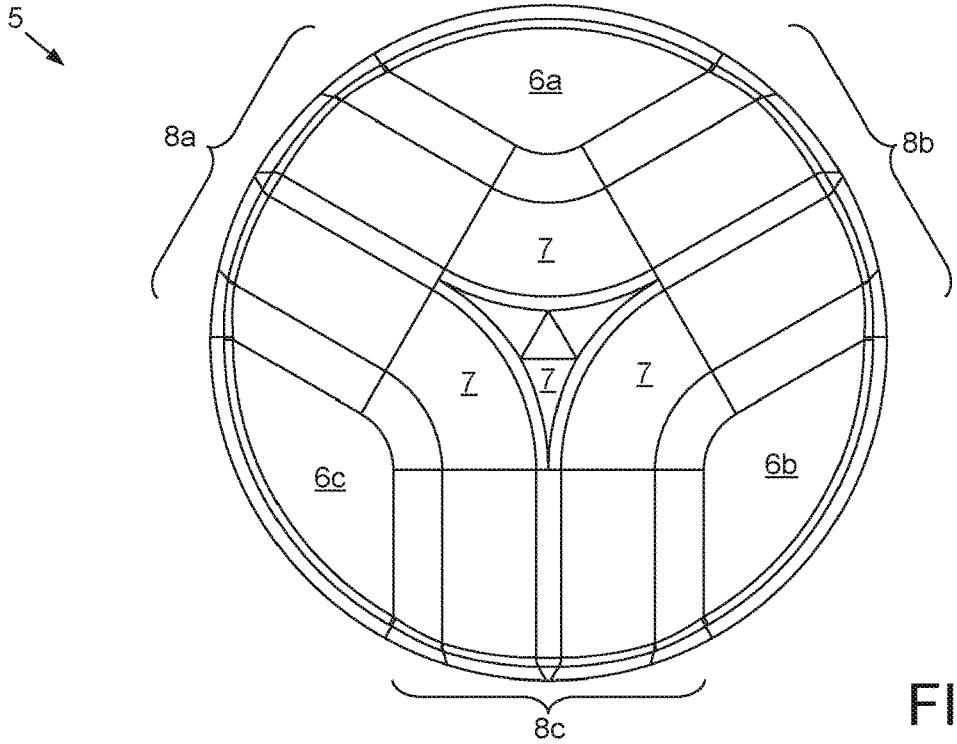
FIG. 1B illustrates a working face of the cutter.
Figure 2A:
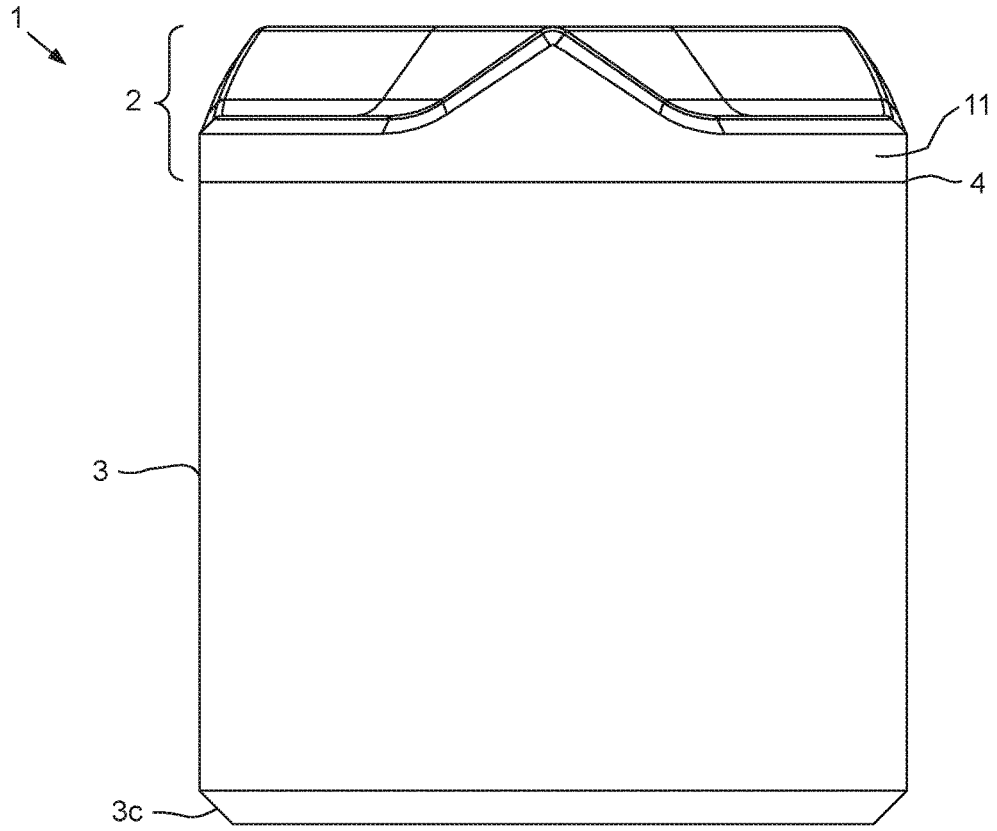
FIG. 2A is a side view of the cutter.
Figure 2B:
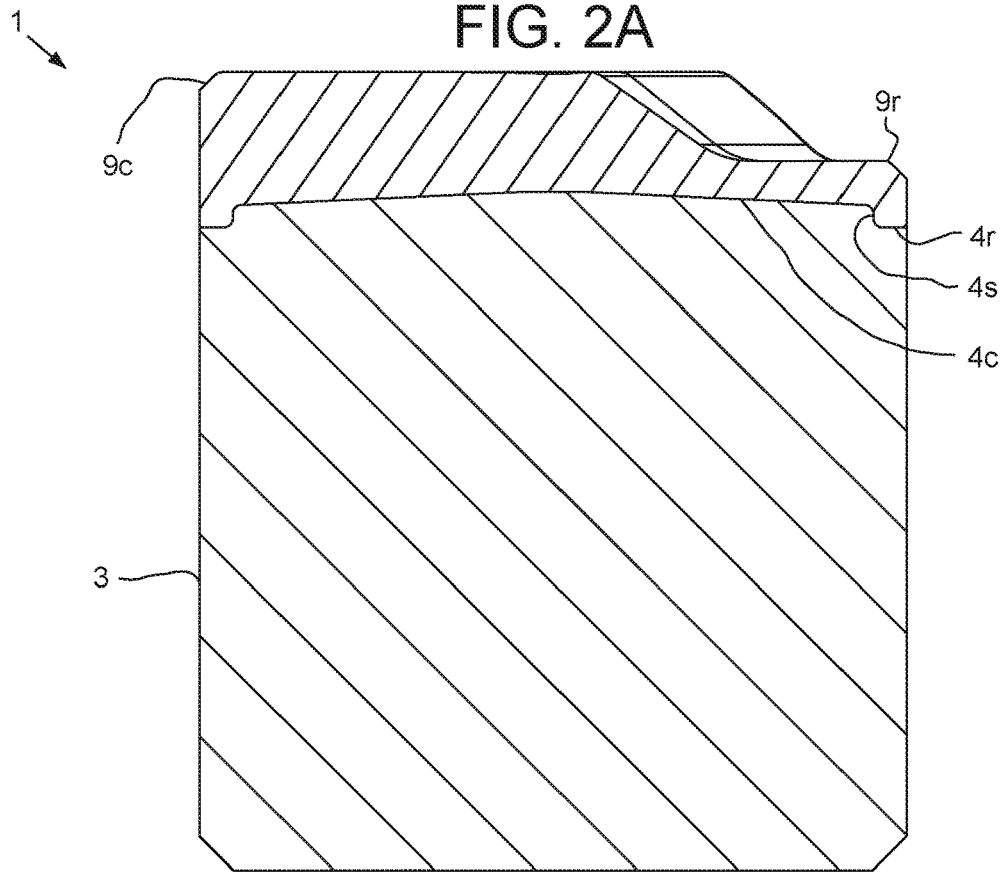
FIG. 2B is a cross-sectional view of the cutter.

FIG. 1A illustrates a cutter 1, according to one embodiment of the present disclosure. FIG. 1B illustrates a working face 5 of the cutter 1. FIG. 2A is a side view of the cutter 1. FIG. 2B is a cross-sectional view of the cutter 1. The cutter 1 may include a cutting table 2 mounted to a cylindrical substrate 3. The cutting table 2 may be circular and the substrate 3 may be a circular cylinder. The cutting table 2 may be made from a superhard material, such as polycrystalline diamond, and the substrate 3 may be made from a hard material, such as a cermet, thereby forming a compact, such as a polycrystalline diamond compact. The cermet may be a cemented carbide, such as a group VIIIB metal-tungsten carbide. The group VIIIB metal may be cobalt. The cutting table 2 may be formed and mounted to the substrate 3 simultaneously in a single step sintering process or the cutter 1 may be made in a two-step process.

The cutting table 2 may have an interface 4 with the substrate 3 at a lower end thereof and the working face 5 at an upper end thereof. The substrate 3 may have the interface 4 at an upper end thereof and a lower end for being received in a pocket of a drill bit 15 (FIG. 3B). The pocket end of the substrate 3 may have a chamfer 3*c* formed in a periphery thereof. The interface 4 may have a planar outer rim 4*r*, an inner non-planar surface 4*c*, and a shoulder 4*s* connecting the outer rim and the inner non-planar surface. The non-planar surface 4*c* of the cutting table 2 may be concave and the non-planar surface of the substrate 3 may be convex.

The working face 5 may have a plurality of recessed bases 6*a-c*, a protruding center section 7, a plurality of protruding ribs 8*a-c*, and an outer edge 9. Each base 6*a-c* may be planar and perpendicular to a longitudinal axis of the cutter 1. The bases 6*a-c* may be located between adjacent ribs 8*a-c* and may each extend inward from a side 11 of the cutting table 2. The outer edge 9 may extend around the working face 5 and may have constant geometry. The outer edge 9 may include a chamfer 9*c* located adjacent to the side 11 and a round 9*r* located adjacent to the bases 6*a-c* and ribs 8*a-c*.

Each rib 8*a-c* may extend radially outward from the center section 7 to the side 11. Each rib 8*a-c* may be spaced circumferentially around the working face 5 at regular intervals, such as at one-hundred twenty degree intervals. Each rib 8*a-c* may have a triangular profile formed by a pair of curved transition surfaces 10*t*, a pair of linearly inclined side surfaces 10*s*, and a round ridge 10*r*. Each transition surface 10*t* may extend from a respective base 6*a-c* to a respective side surface 10*s*. Each ridge 10*r* may connect opposing ends of the respective side surfaces 10*s*. An elevation of each ridge 10*r* may be constant.

An elevation of each ridge 10*r* may range between twenty percent and seventy-five percent of a thickness of the cutting table 2. A width of each rib 8*a-c* may range between twenty and sixty percent of a diameter of the cutting table 2. A radial length of each rib 8*a-c* from the side 11 to the center section 7 may range between fifteen and forty-five percent of the diameter of the cutting table 2. An inclination of each side surface 10*s* relative to the respective base 6*a-c* may range between fifteen and fifty degrees. A radius of curvature of each ridge 10*r* may range between one-eighth and five millimeters or may range between one-quarter and one millimeter.

The center section 7 may have a plurality of curved transition surfaces 7*t*, a plurality of linearly inclined side surfaces 7*s*, and a plurality of round edges 7*r*. Each set of the features 7*r,s,t* may connect respective features 10*r,s,t* of one rib 8*a-c* to respective features of an adjacent rib along an arcuate path. The elevation of the edges 7*r* may be equal to the elevation of the ridges 10*r*. The center section 7 may further have a plateau 7*p* formed between the edges 7*r*, The plateau 7*p* may have a slight dip formed therein.

Figure 3A:
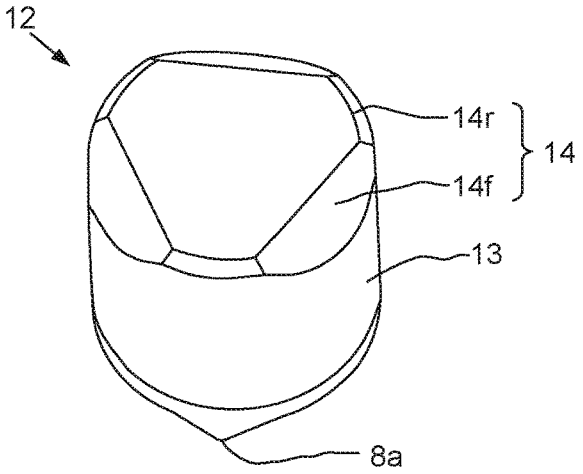
FIG. 3A illustrates a first alternative cutter, according to another embodiment of the present disclosure.
Figure 3B:
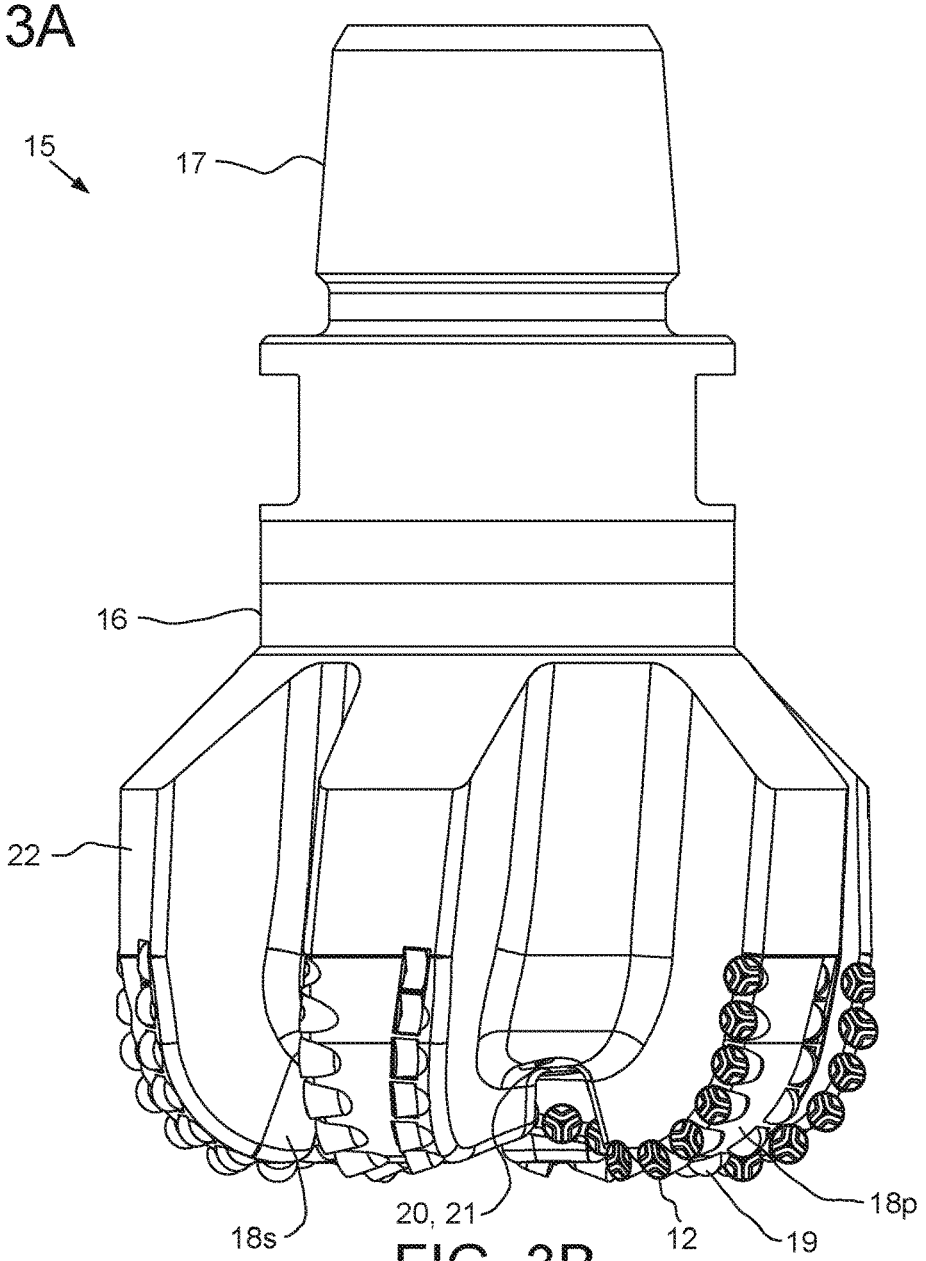
FIG. 3B illustrates a drill bit having a plurality of the first alternative cutters.

FIG. 3A illustrates a first alternative cutter 12, according to another embodiment of the present disclosure. The first alternative cutter 12 may be similar to the cutter 1 except for having an orienting profile 14 formed in a pocket end of a substrate 13. The orienting profile 14 may be polygonal and formed by a plurality of flats 14*f* and a plurality of round portions 14*r* for mating with a complementary profile (not shown) formed in the pocket of the drill bit 15. The orienting profile 14 may have a pair of flats 14*f* and rounds 14*r* for each rib 8*a-c*. Each round portion 14*r* may be aligned with a respective rib 8*a-c*. The complementary profile of the pocket may be oriented such that when the orienting profiles 14 are engaged, one of the ribs 8*a-c* is oriented to engage a formation (not shown) for drilling of a wellbore using the drill bit 15. Once the drill bit 15 has become worn, the first alternative cutter 12 may be demounted from the drill bit and rotated to index the orienting profile, and then reengaged with the pocket of drill bit, thereby orienting a new one of the ribs 8*a-c* to engage the formation.

Alternatively, the orienting profile 14 may include protrusions formed in the pocket end of the substrate 13 instead of the flats 14*f* and the pocket of the drill bit may have mating grooves formed therein or vice versa.

FIG. 3B illustrates the drill bit 15 having a plurality of the first alternative cutters 12. The drill bit 15 may include a bit body 16, a shank 17, a cutting face, and a gage section. The shank 17 may be tubular and include an upper piece and a lower piece connected to the upper piece, such as by threaded couplings secured by a weld. The bit body 16 may be made from a composite material, such as a ceramic and/or cermet body powder infiltrated by a metallic binder. The bit body 16 may be mounted to the lower shank piece during molding thereof. The shank 17 may be made from a metal or alloy, such as steel, and have a coupling, such as a threaded pin, formed at an upper end thereof for connection of the drill bit 15 to a drill collar (not shown). The shank 17 may have a flow bore formed therethrough and the flow bore may extend into the bit body 16 to a plenum thereof. The cutting face may form a lower end of the drill bit 15 and the gage section may form at an outer portion thereof.

Alternatively, the bit body 16 may be metallic, such as being made from steel, and may be hardfaced. The metallic bit body may be connected to a modified shank by threaded couplings and then secured by a weld or the metallic bit body may be monoblock having an integral body and shank.

The cutting face may include one or more primary blades 18*p*, one or more secondary blades 18*s*, fluid courses formed between the blades, the first alternative cutters 12, and a plurality of backup cutters 19. The cutting face may have one or more sections, such as an inner cone, an outer shoulder, and an intermediate nose between the cone and the shoulder. The blades 18*p,s* may be disposed around the cutting face and each blade may be formed during molding of the bit body 16 and may protrude from the bit body. The primary blades 18*p* may each extend from a center of the cutting face, across the cone and nose sections, along the shoulder section, and to the gage section. The secondary blades 18*s* may each extend from a periphery of the cone section, across the nose section, along the shoulder section, and to the gage section. Each blade 18*p,s* may extend generally radially across the cone (primary only) and nose sections with a slight spiral curvature and along the shoulder section 4*s* generally longitudinally with a slight helical curvature. Each blade 18*p,s* may be made from the same material as the bit body 16.

Alternatively, the blades 18*p,s* may be radially straight (no spiral curvature).

The first alternative cutters 12 may be leading cutters for each blade 18*p,s*. The first alternative cutters 12 may be mounted in pockets formed along leading edges of the blades 18*p,s*, such as by brazing. The backup cutters 19 may be mounted in pockets formed along of portions of the blades 18*p,s* in the shoulder section, such as by brazing. The backup cutters 19 may extend into portions of the blades 18*p,s* in the nose section. Each backup cutter 19 may be aligned with or slightly offset from a respective first alternative cutter 12. Each backup cutter 19 may include a superhard planar cutting table, such as polycrystalline diamond, attached to a hard substrate, such as a cermet, thereby forming a compact, such as a polycrystalline diamond compact (PDC). The cermet may be a carbide cemented by a Group VIIIB metal.

One or more ports 20 may be formed in the bit body 16 and each port may extend from the plenum and through the bottom of the bit body to discharge drilling fluid (not shown) along the fluid courses. A nozzle 21 may be disposed in each port 20 and fastened to the bit body 16. The ports 20 may include an inner set of one or more ports disposed adjacent to the center of the cutting face and an outer set of one or more ports disposed at the periphery of the cone section.

The gage section may include a plurality of gage pads 22 and junk slots formed between the gage pads. The junk slots may be in fluid communication with the fluid courses formed between the blades 18*p,s*. The gage pads 22 may be disposed around the gage section and each pad may be formed during molding of the bit body 16 and may protrude from the outer portion of the bit body. Each gage pad 22 may be made from the same material as the bit body 16 and each gage pad may be formed integrally with a respective blade 18*p,s*.

Alternatively, the drill bit 15 may have non-profiled pockets along the leading edges of the blades 18*p,s* and the cutters 1 may be used therewith instead of the first alternative cutters 12. Each cutter 1 may be held at the proper orientation during brazing in the respective pocket.

Figure 4A:
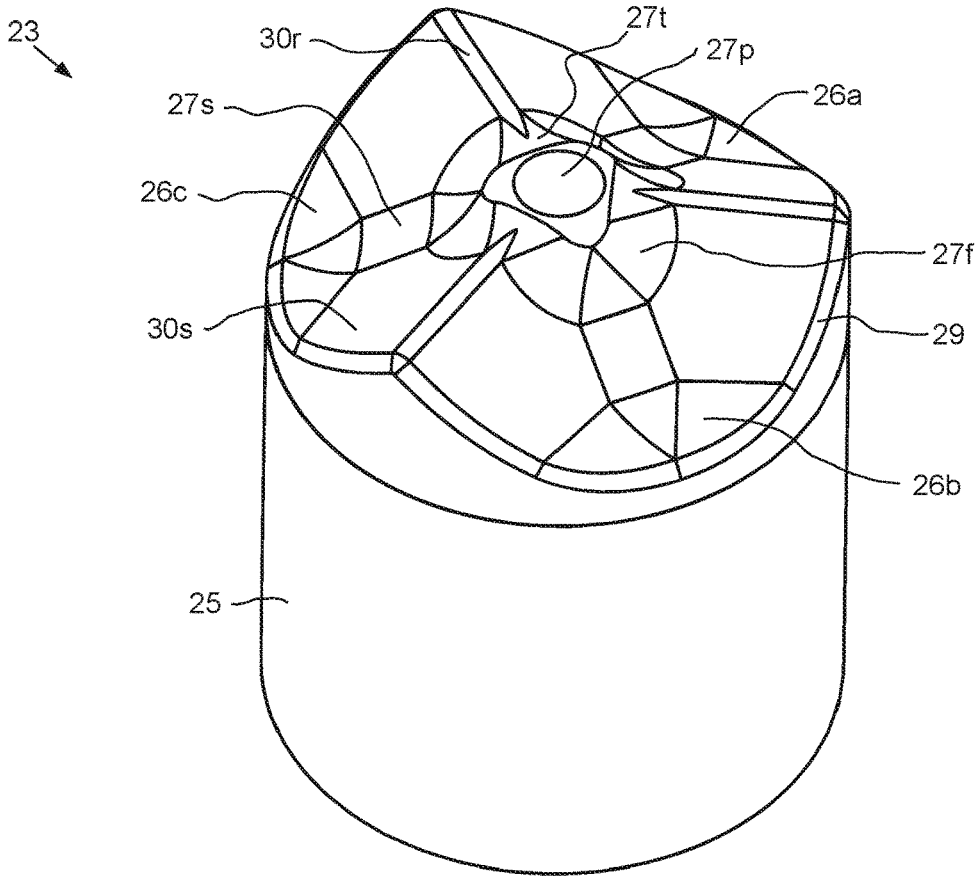
FIG. 4A illustrates a second alternative cutter, according to another embodiment of the present disclosure.
Figure 4B:
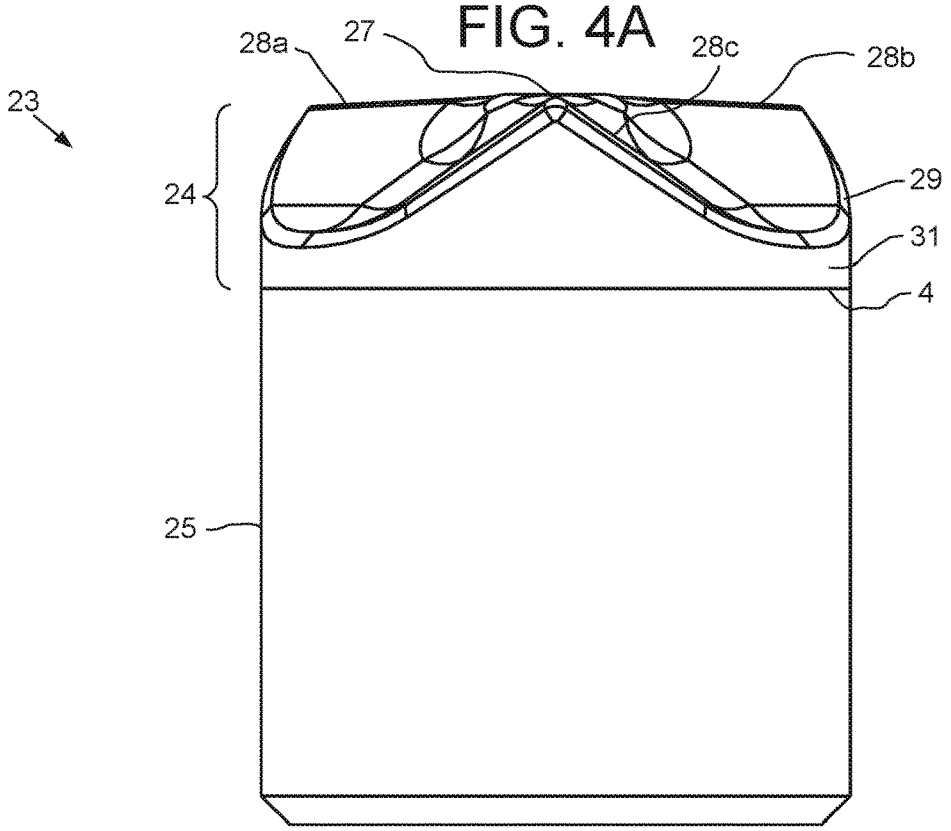
FIG. 4B is a side view of the second alternative cutter.

FIG. 4A illustrates a second alternative cutter 23, according to another embodiment of the present disclosure. FIG. 4B is a side view of the second alternative cutter 23. The second alternative cutter 23 may include a cutting table 24 attached to a cylindrical substrate 25. The cutting table 24 may be circular and the substrate 25 may be a circular cylinder. The cutting table 24 and substrate 25 may be made from the materials discussed above for the cutting table 2 and substrate 3, respectively.

The cutting table 24 may have the interface 4 with the substrate 25 at a lower end thereof and a working face at an upper end thereof. The substrate 25 may have the interface 4 at an upper end thereof and a lower end for being received in the pocket of the drill bit 15. The pocket end of the substrate 25 may have the chamfer 3*c* formed in a periphery thereof.

The working face may have a plurality of recessed bases 26*a-c*, a protruding center section 27, a plurality of protruding ribs 28*a-c*, and an outer edge 29. Each base 26*a-c* may be parabolic. The bases 26*a-c* may be located between adjacent ribs 28*a-c* and may each extend inward from a side 31 of the cutting table 24. The outer edge 29 may extend around the working face and may have constant geometry. The outer edge 29 may be a chamfer connecting the side 31 to the cutting face.

Each rib 28*a-c* may extend radially outward from the center section 27 to the side 31. Each rib 28*a-c* may be spaced circumferentially around the working face at regular intervals, such as at one-hundred twenty degree intervals. Each rib 28*a-c* may have a triangular profile formed by a pair of linearly inclined side surfaces 30*s* and a round ridge 30*r*. Each side surface 30*s* may extend from a respective base 26*a-c* to a respective ridge 30*r*. Each ridge 30*r* may connect opposing ends of the respective side surfaces 30*s*. An elevation of each ridge 30*r* may increase from the side 31 to the center section 27.

A maximum elevation of each ridge 30*r* may range between twenty percent and seventy-five percent of a thickness of the cutting table 24. A width of each rib 28*a-c* may range between twenty and sixty percent of a diameter of the cutting table 24. A radial length of each rib 28*a-c* from the side 31 to the center section 27 may range between fifteen and forty-five percent of the diameter of the cutting table 24. An inclination of each side surface 30*s* relative to the respective base 26*a-c* may range between fifteen and fifty degrees. A radius of curvature of each ridge 30*r* may range between one-eighth and five millimeters or may range between one-quarter and one millimeter. An inclination angle of each ridge 30*r* may range between one and ten degrees.

The center section 27 may have a plurality of linearly inclined side surfaces 27*s*, a plurality of parabolic faces 27*f*, a plurality of termini 27*t*, and a plateau 27*p*. Each set of the features 27*f,s* may connect respective features 30*s* of one rib 28*a-c* to respective features of an adjacent rib along a curved path. Each terminus 27*t* may receive an inner end of a respective ridge 30*r*. The termini 27*t* may be formed between the faces 27*f*. The plateau 27*p* may be located adjacent to inner edges of the parabolic faces 27*f* and the termini 27*t*. The plateau 27*p* may have an elevation slightly greater than the maximum elevation of the ridges 30*r*.

Alternatively, the pocket end of the substrate 25 may have the orienting profile 14 formed therein.

Figure 5A:
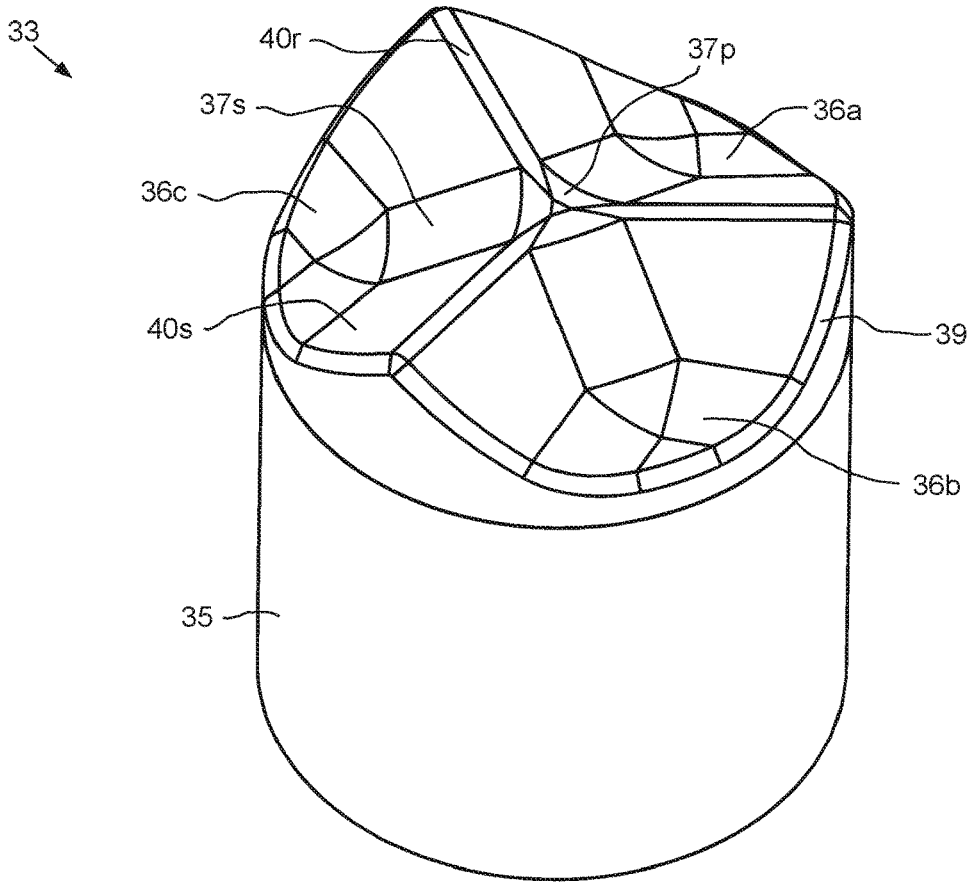
FIG. 5A illustrates a third alternative cutter, according to another embodiment of the present disclosure.
Figure 5B:
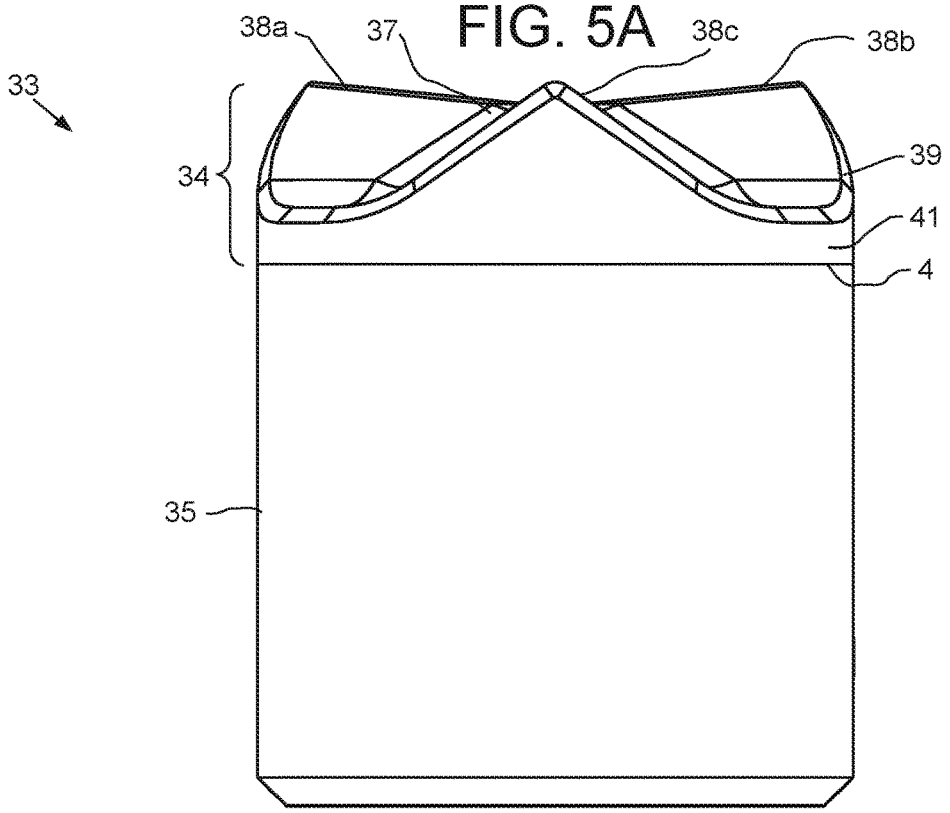
FIG. 5B is a side view of the third alternative cutter.

FIG. 5A illustrates a third alternative cutter 33, according to another embodiment of the present disclosure. FIG. 5B is a side view of the third alternative cutter. The third alternative cutter 33 may include a cutting table 34 attached to a cylindrical substrate 35. The cutting table 34 may be circular and the substrate 35 may be a circular cylinder. The cutting table 34 and substrate 35 may be made from the materials discussed above for the cutting table 2 and substrate 3, respectively.

The cutting table 34 may have the interface 4 with the substrate 35 at a lower end thereof and a working face at an upper end thereof. The substrate 35 may have the interface 4 at an upper end thereof and a lower end for being received in the pocket of the drill bit 15. The pocket end of the substrate 35 may have the chamfer 3*c* formed in a periphery thereof.

The working face may have a plurality of recessed bases 36*a-c*, a protruding center section 37, a plurality of protruding ribs 38*a-c*, and an outer edge 39. Each base 36*a-c* may be parabolic. The bases 36*a-c* may be located between adjacent ribs 38*a-c* and may each extend inward from a side 41 of the cutting table 34. The outer edge 39 may extend around the working face and may have constant geometry. The outer edge 39 may be a chamfer connecting the side 41 to the cutting face.

Each rib 38*a-c* may extend radially outward from the center section 37 to the side 41. Each rib 38*a-c* may be spaced circumferentially around the working face at regular intervals, such as at one-hundred twenty degree intervals. Each rib 38*a-c* may have a triangular profile formed by a pair of linearly inclined side surfaces 40*s* and a round ridge 40*r*. Each side surface 40*s* may extend from a respective base 36*a-c* to a respective ridge 40*r*. Each ridge 40*r* may connect opposing ends of the respective side surfaces 40*s*. An elevation of each ridge 40*r* may decrease from the side 41 to the center section 37.

A maximum elevation of each ridge 40*r* may range between twenty percent and seventy-five percent of a thickness of the cutting table 34. A width of each rib 38*a-c* may range between twenty and sixty percent of a diameter of the cutting table 34. A radial length of each rib 38*a-c* from the side 41 to the center section 37 may range between thirty and fifty percent of the diameter of the cutting table 34. An inclination of each side surface 40*s* relative to the respective base 36*a-c* may range between fifteen and fifty degrees. A radius of curvature of each ridge 40*r* may range between one-eighth and five millimeters or may range between one-quarter and one millimeter. A declination angle of each ridge 40*r* may range between one and ten degrees.

The center section 37 may have a plurality of linearly inclined side surfaces 37*s* and a plateau 37*p*. Each side surface 37*s* may connect the respective side surface 40*s* of one rib 38*a-c* to a respective side surface of an adjacent rib along a curved path. The plateau 37*p* may include a plurality of trapezoidal faces disposed between inner ends of adjacent ridges 40*r* and a terminus receiving inner tips of the ridges. The plateau 37*p* may have an elevation slightly less than the minimum elevation of the ridges 40*r*.

Alternatively, the pocket end of the substrate 35 may have the orienting profile 14 formed therein.

Figure 6A:
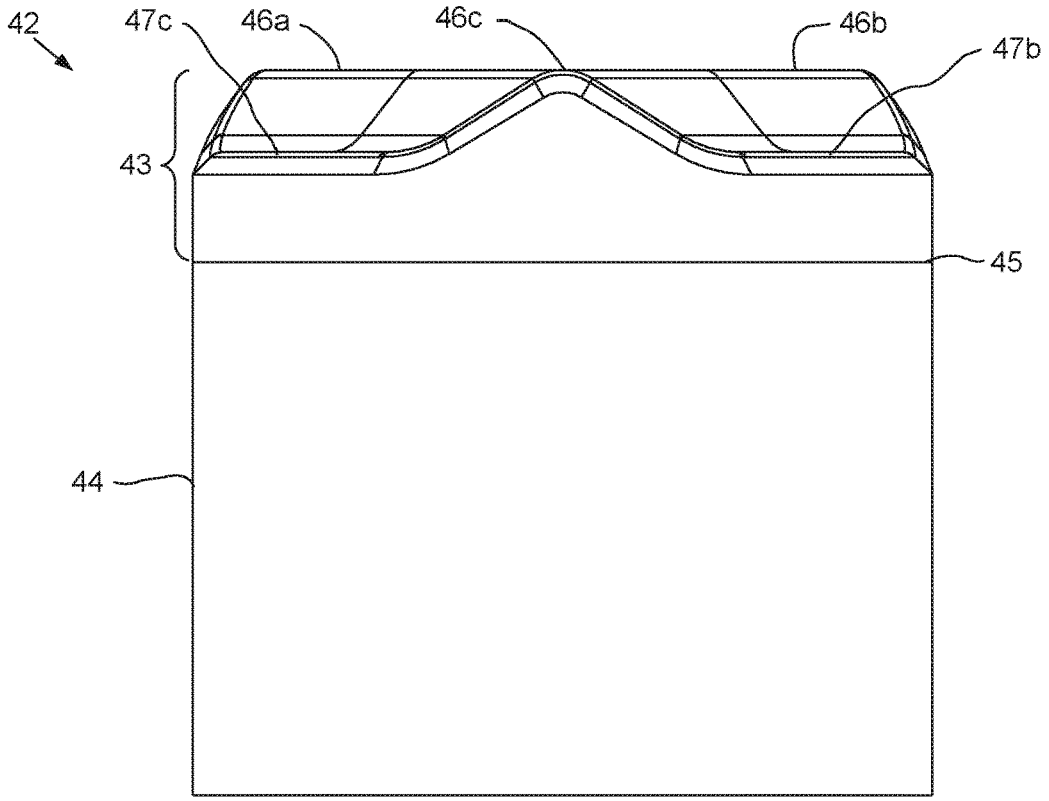
FIG. 6A is a side view of a fourth alternative cutter, according to another embodiment of the present disclosure.
Figure 6B:
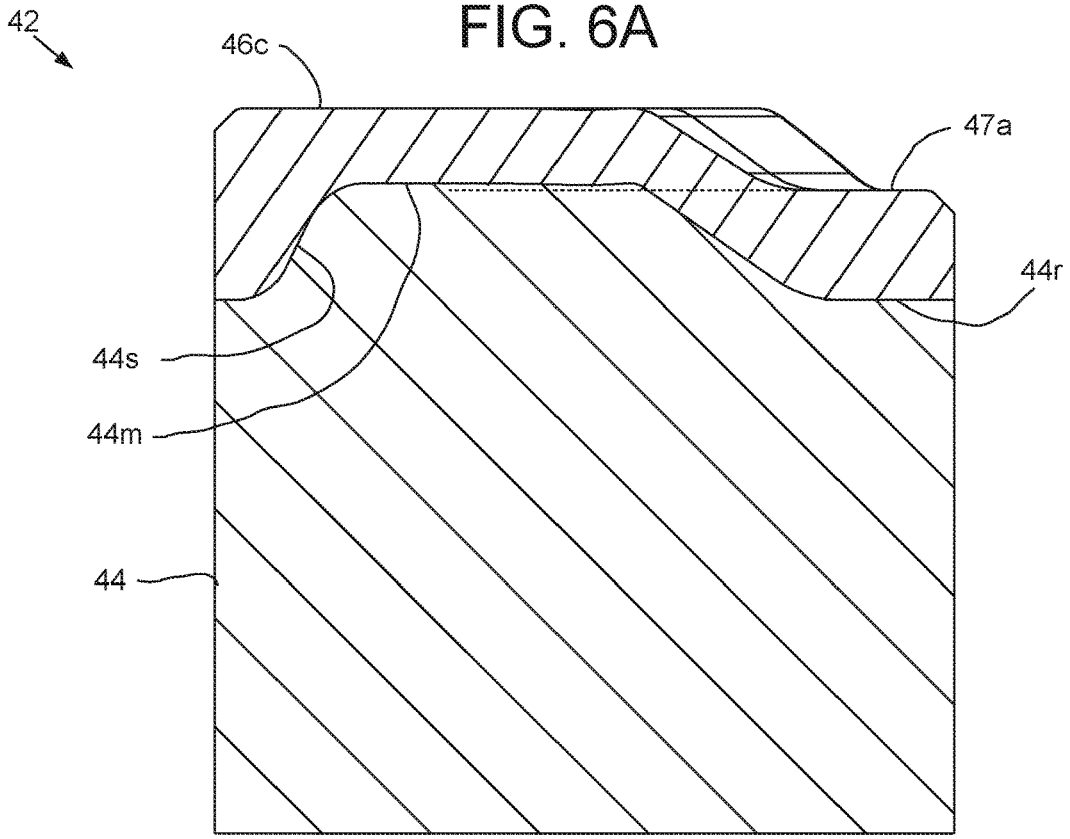
FIG. 6B is a cross-sectional view of the fourth alternative cutter.

FIG. 6A is a side view of a fourth alternative cutter 42, according to another embodiment of the present disclosure. FIG. 6B is a cross-sectional view of the fourth alternative cutter 42. The fourth alternative cutter 42 may be similar to the cutter 1 except for having a modified interface 45 between a substrate 44 and a cutting table 43 thereof. The substrate 44 may have the modified interface 45 at an upper end thereof and a lower end for being received in a pocket of the drill bit 15. The substrate upper end may have a planar outer rim 44*r*, an inner mound 44*m* for each rib 46*a-c*, and a shoulder 44*s* connecting the outer rim and each inner mound. A shape and location of the mounds 44*m* may correspond to a shape and location of the ribs 46*a-c* and a shape and location of the outer rim 44*r* may correspond to a shape and location of the bases 47*a-c* except that the mounds may not extend to a side of the substrate 44. Ridges of the mounds 44*m* may be slightly above the bases 47*a,b* (see dashed line in FIG. 6B). A height of the mounds 44*m* may be greater than an elevation of the ribs 46*a-c*.

Alternatively, a ridge of each mound 44*m* may be level with or slightly below the bases 47*a-c*. Alternatively, any of the other cutters 12, 23, 33 discussed above may have the modified interface 45.

Figure 7A:
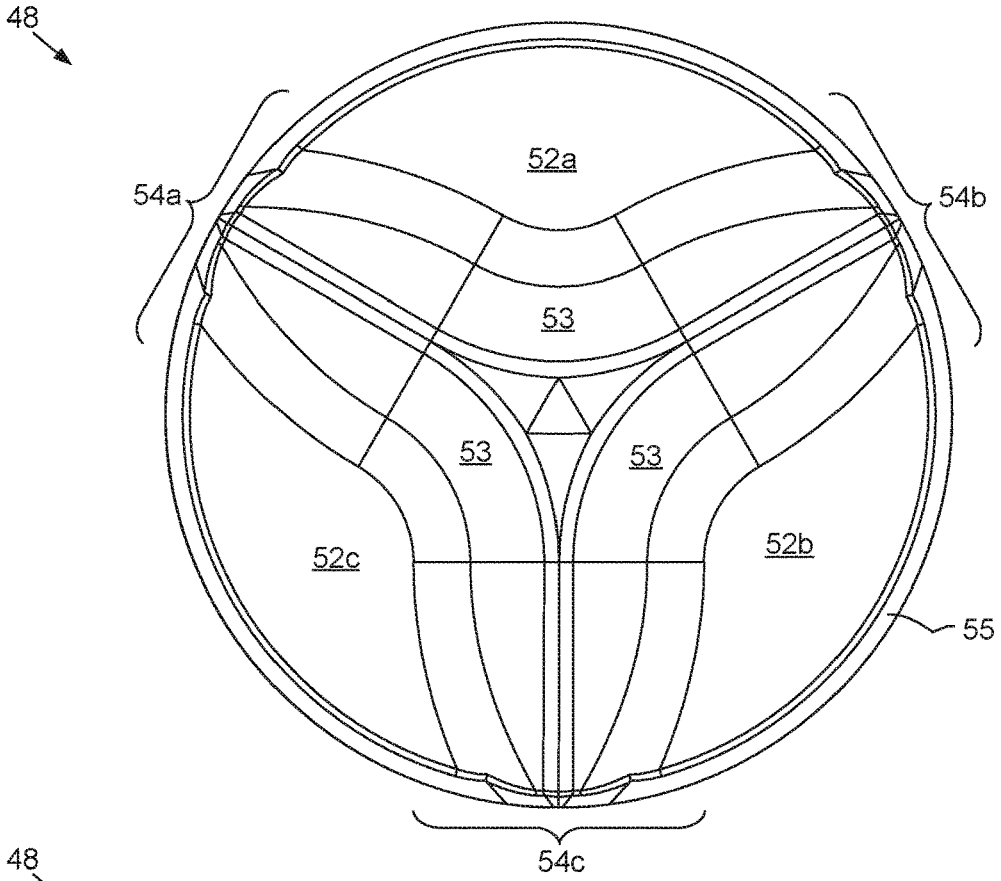
FIG. 7A illustrates a working face of a fifth alternative cutter, according to another embodiment of the present disclosure.
Figure 7B:
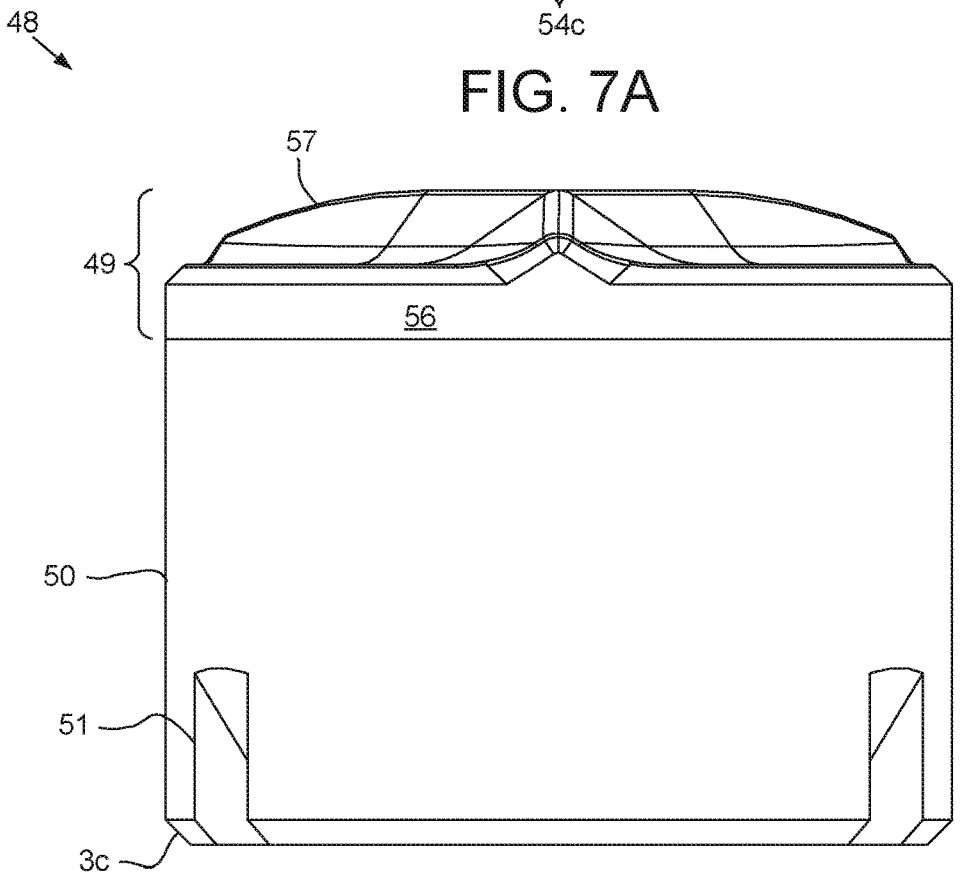
FIG. 7B is a side view of the fifth alternative cutter.

FIG. 7A illustrates a working face of a fifth alternative cutter 48, according to another embodiment of the present disclosure. FIG. 7B is a side view of the fifth alternative cutter 48. The fifth alternative cutter 48 may include a cutting table 49 attached to a cylindrical substrate 50. The cutting table 49 may be circular and the substrate 50 may be a circular cylinder. The cutting table 49 and substrate 50 may be made from the materials discussed above for the cutting table 2 and substrate 3, respectively.

The cutting table 49 may have either the interface (not shown, see interface 4) or the modified interface (not shown, see modified interface 45) with the substrate 50 at a lower end thereof and a working face at an upper end thereof. The substrate 50 may have either interface at an upper end thereof and a lower end for being received in the pocket of the drill bit 15. The pocket end of the substrate 50 may have the chamfer 3*c* formed in a periphery thereof and an orienting profile 51 formed therein. The orienting profile 51 may include one or more (pair shown) slots for mating with a complementary profile (not shown) formed in the pocket of the drill bit 15.

Alternatively, any of the other cutters 12, 23, 33, 42 discussed above may have the orienting profile 51.

The working face may have a plurality of recessed bases 52*a-c*, a protruding center section 53, a plurality of protruding ribs 54*a-c*, and an outer edge 55. Each base 52*a-c* may be parabolic. The bases 52*a-c* may be located between adjacent ribs 54*a-c* and may each extend inward from a side 56 of the cutting table 49. The outer edge 55 may extend around the working face and may have constant geometry. The outer edge 55 may be a chamfer connecting the side 56 to the cutting face.

Each rib 54*a-c* may extend radially outward from the center section 53 to the side 56. Each rib 54*a-c* may be spaced circumferentially around the working face at regular intervals, such as at one-hundred twenty degree intervals. Each rib 54*a-c* may have a triangular profile formed by a pair of curved transition surfaces, a pair of linearly inclined side surfaces, and a round ridge 57. Each transition surface may extend from a respective base 52*a-c* to a respective side surface. Each transition surface may terminate at the outer edge 55 as opposed to extending to the side 56. Each ridge 57 may connect opposing ends of the respective side surfaces.

An elevation of each ridge 57 may increase from the side 56 to the center section 53. The elevation of each ridge 57 may increase in a linear fashion at a portion adjacent to the edge 55 and then in a curved fashion as the ridge extends from the adjacent portion toward the center section 53. A ratio between a minimum elevation of the ridges 57 and a maximum elevation of the ridges may range between one-sixth and two-thirds.

A width of each rib 54*a-c* may increase from the side 56 to the center section 53. The width of each rib 54*a-c* may increase in a linear and step-wise fashion at a the edge 55 and then in a curved fashion as the rib extends from the edge toward the center section 53. A ratio between a minimum width of the ribs 54*a-c* and a maximum width of the ribs may range between one-sixth and two-thirds.

A maximum elevation of each ridge 57 may range between twenty percent and seventy-five percent of a thickness of the cutting table 49. A maximum width of each rib 54*a-c* may range between twenty and sixty percent of a diameter of the cutting table 49. A radial length of each rib 54*a-c* from the side 56 to the center section 53 may range between fifteen and forty-five percent of the diameter of the cutting table 49. An inclination of each side surface relative to the respective base 36*a-c* may range between fifteen and fifty degrees. A radius of curvature of each ridge 57 may range between one-eighth and five millimeters or may range between one-quarter and one millimeter. An inclination angle of the adjacent portion of each ridge 57 may range between ten and forty degrees.

The center section 53 may have a plurality of curved transition surfaces, a plurality of linearly inclined side surfaces, and a plurality of round edges. Each set of the features may connect respective features of one rib 54*a-c* to respective features of an adjacent rib along an arcuate path. The elevation of the edges may be equal to the maximum elevation of the ridges 57. The center section 53 may further have a plateau formed between the edges. The plateau may have a slight dip formed therein.

Figure 8A:
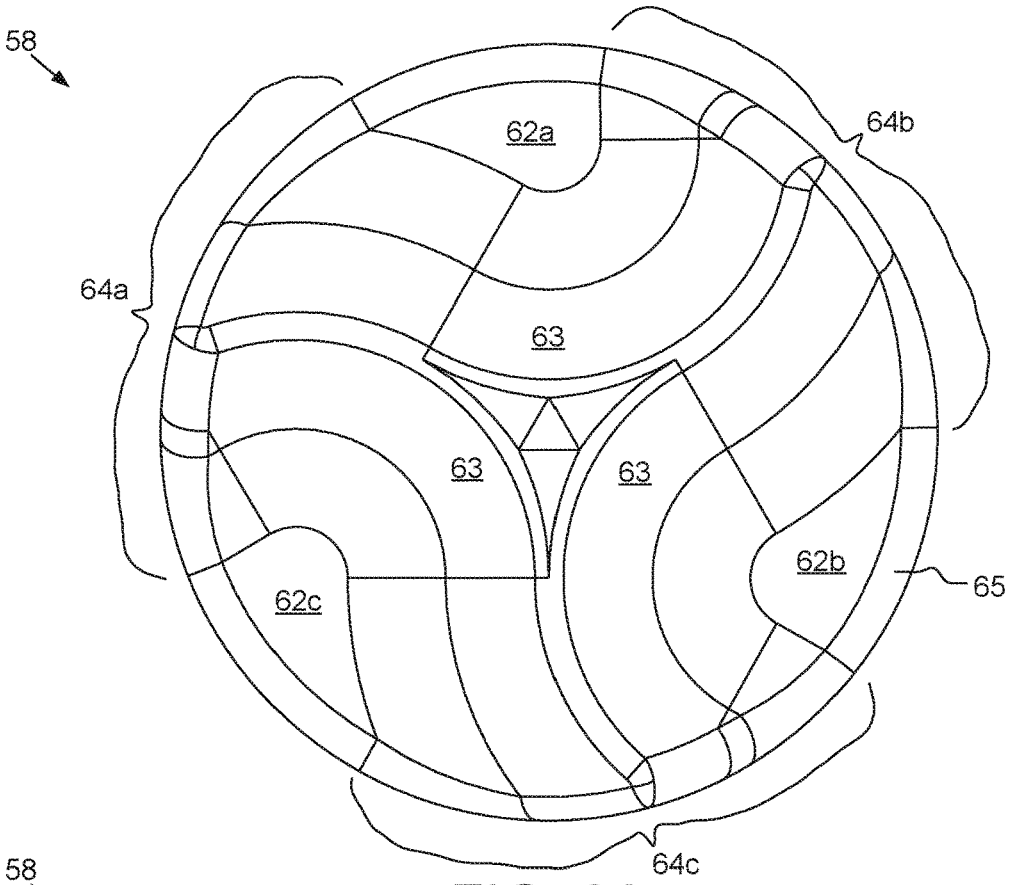
FIG. 8A illustrates a working face of a sixth alternative cutter, according to another embodiment of the present disclosure.
Figure 8B:
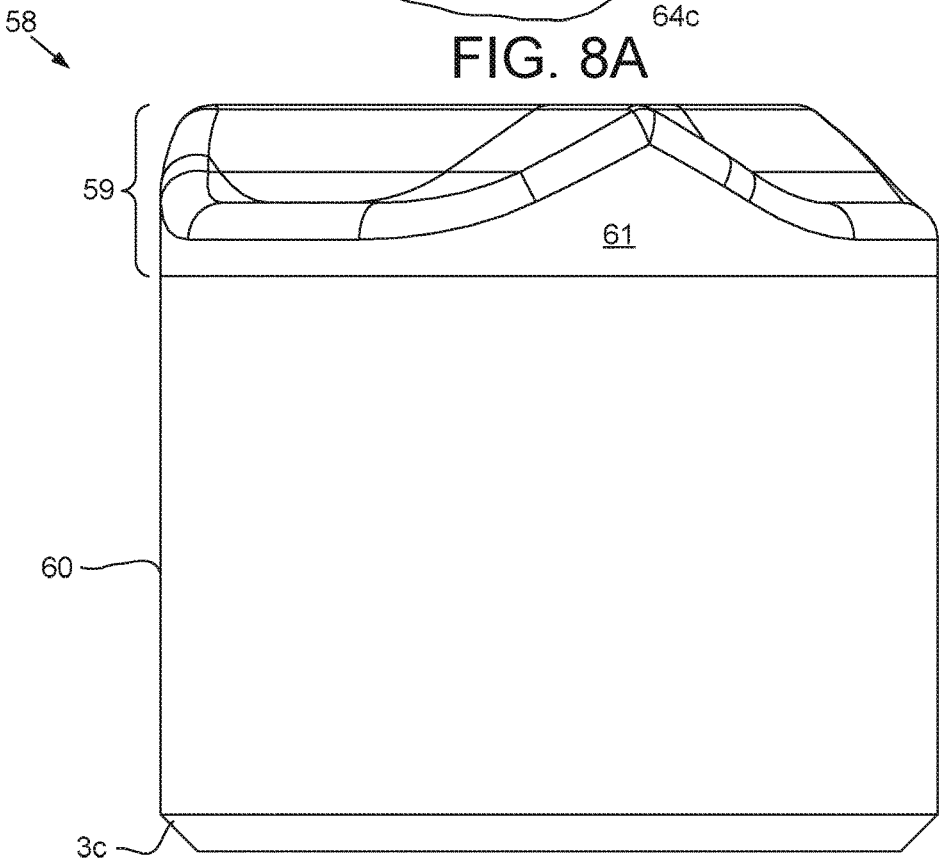
FIG. 8B is a side view of the sixth alternative cutter.

FIG. 8A illustrates a working face of a sixth alternative cutter 58, according to another embodiment of the present disclosure. FIG. 8B is a side view of the sixth alternative cutter 58. The sixth alternative cutter 58 may include a cutting table 59 attached to a cylindrical substrate 60. The cutting table 59 may be circular and the substrate 60 may be a circular cylinder. The cutting table 59 and substrate 60 may be made from the materials discussed above for the cutting table 2 and substrate 3, respectively.

The cutting table 59 may have either the interface (not shown, see interface 4) or the modified interface (not shown, see modified interface 45) with the substrate 60 at a lower end thereof and a working face at an upper end thereof. The substrate 60 may have either interface at an upper end thereof and a lower end for being received in the pocket of the drill bit 15. The pocket end of the substrate 60 may have the chamfer 3*c* formed in a periphery thereof and one of the orienting profiles discussed above therein.

The working face may have a plurality of recessed bases 62*a-c*, a protruding center section 63, a plurality of protruding ribs 64*a-c*, and an outer edge 65. The bases 62*a-c* may be located between adjacent ribs 54*a-c* and may each extend inward from a side 61 of the cutting table 59. The outer edge 65 may extend around the working face and may have variable geometry. The outer edge 65 may be a round or chamfer connecting the side 61 to the cutting face.

Each rib 64*a-c* may extend spirally outward from the center section 63 to the side 61. The spiral curvature of the ribs 64*a-c* may be clockwise or counter-clockwise. Each rib 64*a-c* may be spaced circumferentially around the working face at regular intervals, such as at one-hundred twenty degree intervals. Each rib 64*a-c* may have a triangular profile formed by a pair of curved transition surfaces, a pair of linearly inclined side surfaces, and a round ridge. Each transition surface may extend from a respective base 62*a-c* to a respective side surface. Each ridge may connect opposing ends of the respective side surfaces. An elevation of each ridge may be constant.

An elevation of each ridge may range between twenty percent and seventy-five percent of a thickness of the cutting table 59. A width of each rib 64*a-c* may range between twenty-five and seventy-five percent of a diameter of the cutting table 59. An inclination of each side surface relative to the respective base 62*a-c* may range between fifteen and fifty degrees. A radius of curvature of each ridge may range between one-eighth and five millimeters or may range between one-quarter and one millimeter.

The center section 63 may have a plurality of curved transition surfaces, a plurality of linearly inclined side surfaces, and a plurality of round edges. Each set of the features may connect respective features of one rib 64*a-c* to respective features of an adjacent rib along an arcuate path. The elevation of the edges may be equal to the elevation of the ridges. The center section 63 may further have a plateau formed between the edges. The plateau may have a slight dip formed therein.

Conventional shear cutters generate long cuttings during drilling of soft formations. These long cuttings are difficult to transport from the drill bit, up the annulus, and to surface. The ribs 8*a-c*, 28*a-c*, 38*a-c*, 46*a-c*, 54*a-c*, 64*a-c* of the respective cutters 1, 12, 23, 33, 42, 48, 58 serve as chip-breakers to prevent formation of long cuttings and facilitate evacuation of the cuttings from the drill bit 15. The ribs 8*a-c*, 28*a-c*, 38*a-c*, 46*a-c*, 54*a-c*, 64*a-c* of the respective cutters 1, 12, 23, 33, 42, 48, 58 also present a sharp cutting edge for drilling soft formations. For drilling hard formations, the ribs 8*a-c*, 28*a-c*, 38*a-c*, 46*a-c*, 54*a-c*, 64*a-c* of the respective cutters 1, 12, 23, 33, 42, 48, 58 exert point-loading on the formation, thereby utilizing crack formation and propagation as a failure mode to cut the hard formation. Further, the protruding ribs 8*a-c*, 28*a-c*, 38*a-c*, 46*a-c*, 54*a-c*, 64*a-c* create additional surface area to facilitate cooling of the respective cutting tables 2, 24, 34, 43, 49, 59. Further, conventional shear cutters tend to form wear flats when drilling abrasive formations. The wear flats in turn are susceptible to thermal failure. The ribs 8*a-c*, 28*a-c*, 38*a-c*, 46*a-c*, 54*a-c*, 64*a-c* of the respective cutters 1, 12, 23, 33, 42, 48, 58 can be indexed to a new rib to discourage formation of wear flats.

While the foregoing is directed to embodiments of the present disclosure, other and further embodiments of the disclosure may be devised without departing from the basic scope thereof, and the scope of the invention is determined by the claims that follow.

The invention claimed is:

1. A cutter for a drill bit, comprising:
- a substrate for mounting the cutter to the drill bit; and
- a cutting table made from a superhard material, mounted to the substrate, having an interface with the substrate at a lower end thereof, and having a working face at an upper end thereof, the working face having:
  - a protruding center section;
  - a plurality of protruding ribs, wherein:
    - each rib extends radially outward from the center section to a side of the cutting table, and
    - each rib has a triangular profile formed by a pair of inclined side surfaces and a ridge connecting opposing ends of the side surfaces; and
  - a plurality of recessed bases located between adjacent ribs and each extending inward from the side,
  - wherein:
    - a maximum elevation of each ridge ranges between twenty percent and seventy-five percent of a maximum thickness of the cutting table, and
    - a width of each rib ranges between thirty and sixty percent of a diameter of the cutting table.

2. The cutter of claim 1, wherein an elevation of the ridges is constant.

3. The cutter of claim 2, wherein an elevation of the center section equals the elevation of the ribs.

4. The cutter of claim 1, wherein an elevation of the ridges increases from the side to the center section.

5. The cutter of claim 4, wherein an elevation of the center section is greater than a maximum elevation of the ridges.

6. The cutter of claim 4, wherein a width of each rib increases from the side to the center section.

7. The cutter of claim 1, wherein an elevation of the ridges decreases from the side to the center section.

8. The cutter of claim 7, wherein an elevation of the center section is less than a minimum elevation of the ridges.

9. The cutter of claim 1, wherein the substrate has an orienting profile formed in a pocket end thereof opposite the interface.

10. The cutter of claim 1, wherein:

the working face further has an outer edge extending around the working face, and the outer edge comprises a chamfer.

11. The cutter of claim 1, wherein:

each ridge is round, and each ridge has a radius of curvature ranging between one-eighth and five millimeters.

12. The cutter of claim 1, wherein:

each base is planar, and each base is perpendicular to a longitudinal axis of the cutter.

13. The cutter of claim 1, wherein:

the center section has a plurality of side surfaces, each side surface connects side surfaces of adjacent ribs, and the center section has a plateau located between the side surfaces of the center section.

14. The cutter of claim 1, wherein the interface has a planar outer rim, an inner non-planar surface, and a shoulder connecting the outer rim and the inner non-planar surface.

15. The cutter of claim 1, wherein:

an upper end of the substrate forming part of the interface has a planar outer rim, an inner mound for each rib, and a shoulder connecting the outer rim and each inner mound, and a shape and location of the mounds corresponds to a shape and location of the ribs and a shape and location of the outer rim corresponds to a shape and location of the bases except that the mounds do not extend to a side of the substrate.

16. The drill bit comprising the cutter of claim 1 and further comprising:

a shank having a coupling formed at an upper end thereof;

a bit body mounted to a lower end of the shank;

a gage section forming an outer portion of the drill bit; and a cutting face forming a lower end of the drill bit and comprising:

a plurality of blades protruding from the bit body, each blade extending from a center of the cutting face to the gage section, wherein each blade has a plurality of the cutters mounted therealong.

17. A cutter for a drill bit, comprising:

a substrate for mounting the cutter to the drill bit; and a cutting table made from a superhard material, mounted to the substrate, having an interface with the substrate at a lower end thereof, and having a working face at an upper end thereof, the working face having:

a protruding center section;

a plurality of protruding ribs, wherein:

each rib extends radially outward from the center section to a side of the cutting table, and each rib has a triangular profile formed by a pair of inclined side surfaces and a ridge connecting opposing ends of the side surfaces; and a plurality of recessed bases located between adjacent ribs and each extending inward from the side, wherein an elevation of the ridges decreases from the side to the center section.

18. The cutter of claim 17, wherein an elevation of the center section is less than a minimum elevation of the ridges.

19. A cutter for a drill bit, comprising:

a substrate for mounting the cutter to the drill bit; and a cutting table made from a superhard material, mounted to the substrate, having an interface with the substrate at a lower end thereof, and having a working face at an upper end thereof, the working face having:

a protruding center section;

a plurality of protruding ribs, wherein:

each rib extends radially outward from the center section to a side of the cutting table, and each rib has a triangular profile formed by a pair of inclined side surfaces and a ridge connecting opposing ends of the side surfaces; and a plurality of recessed bases located between adjacent ribs and each extending inward from the side, wherein:

an upper end of the substrate forming part of the interface has a planar outer rim, an inner mound for each rib, and a shoulder connecting the outer rim and each inner mound, and a shape and location of the mounds corresponds to a shape and location of the ribs and a shape and location of the outer rim corresponds to a shape and location of the bases except that the mounds do not extend to a side of the substrate.

* * * * *